United States Patent [19]

Yoshida

[11] 4,133,084

[45] Jan. 9, 1979

[54] SLIDE FASTENER WITH CONTINUOUS COUPLING ELEMENTS

[75] Inventor: Hiroshi Yoshida, Uozu, Japan

[73] Assignee: Yoshida Kogo K.K., Tokyo, Japan

[21] Appl. No.: 839,437

[22] Filed: Oct. 5, 1977

[30] Foreign Application Priority Data

Oct. 12, 1976 [JP] Japan ..... 51-136870[U]

[51] Int. Cl.[2] ..... A44B 19/04

[52] U.S. Cl. ..... 24/205.16 C

[58] Field of Search ..... 24/205.16 R, 205.16 C, 24/205.13 C

[56] References Cited

U.S. PATENT DOCUMENTS

| | | | |
|---|---|---|---|
| 2,867,879 | 1/1959 | Urban et al. | 24/205.16 R |
| 3,057,031 | 10/1962 | Wahl | 24/205.16 C |
| 3,783,476 | 1/1974 | Fröhlich | 24/205.16 C |
| 4,058,145 | 11/1977 | Fröhlich et al. | 24/205.16 C |

FOREIGN PATENT DOCUMENTS

| | | | |
|---|---|---|---|
| 1240114 | 7/1971 | United Kingdom | 24/205.16 C |

*Primary Examiner*—Kenneth J. Dorner
*Attorney, Agent, or Firm*—Bucknam and Archer

[57] ABSTRACT

A fastener stringer is disclosed which has a coil-type continuous coupling element of the oval-shaped cross section. The coupling element is stitched onto a support tape which is substantially integrally provided with a levelling cord extending longitudinally of the tape and partly raised from its element-carrying surface. The lower shanks of the scoops formed by the coupling element lie against the levelling cord at their regions adjacent to the bight portions connecting the scoops, so that a notional line extending between the midpoint of the coupling head of each scoop and the midpoint of the corresponding bight portion is oriented substantially parallel to the plane of the support tape.

4 Claims, 7 Drawing Figures

SLIDE FASTENER WITH CONTINUOUS COUPLING ELEMENTS

BACKGROUND OF THE INVENTION

1. Field of the Invention

This invention relates to slide fasteners and, more particularly, to a slide fastener of the type having continuous coupling elements in the form of coils of filamentary synthetic-resin material. The invention is directed even more particularly to the improved construction of a slide fastener stringer including a coil-type continuous coupling element the turns of which are substantially oval in shape.

2. Description of the Prior Art

In a conventional slide fastener having coil-type continuous coupling elements of the oval-shaped cross section (FIGS. 1 through 4), the coupling elements are stitched onto respective support or stringer tape in such a way that the upper shanks of the scoops formed by each coupling element slope downwardly as they extend rearwardly from the coupling heads toward the bight portions. As a consequence, when the closed slide fastener is bent about an axis extending in the transverse direction of the fastener, the stitches passing over the upper shanks are easy to slip toward the bight portions, thereby giving rise to the possibility of scoop dislodgement or disengagement, as will be later explained in more detail.

SUMMARY OF THE INVENTION

It is an object of this invention to provide an improved slide fastener employing coil-type continuous coupling elements of substantially oval-shaped cross section, which provides a more secure attachment of the coupling elements to the respective support tapes than heretofore.

Another object of the invention is to provide a slide fastener which enables the establishment of the correst attitude of the coupling elements on the support tapes, so that the coupling elements can be held positively interengaged in spite of the stresses to which the fastener may be subjected in use.

A further object of the invention is to provide a slide fastener wherein the coupling elements can be affixed securely and in the correct attitude to the support tapes through an extremely simple and economical procedure.

These and other objects are attained, in accordance with this invention, by a slide fastener stringer including a support tape which is substantially integrally provided with a levelling cord extending longitudinally of the support tape in the adjacency of a front edge thereof and at least partly raised from one of its surfaces. A coil-type continuous coupling element of substantially oval-shaped cross section is stitched onto said one surface of the support tape so as to extend along the front longitudinal edge thereof. The lower shanks of the scoops formed by the coupling element lie against the levelling cord at their regions adjacent to the bight portions bridging the scoops, so that the notional line extending between the midpoint of the coupling head of each scoop and the midpoint of the corresponding bight portion is oriented substantially parallel to the plane of the support tape. The desired correct attitude of the coupling element on the support tape is thus established.

Preferably, the fastener stringer further includes a core cord extending through the interior of the coiled coupling element and disposed in contact with its bight portions. The stitching thread passes through this core cord and through the support tape so as to be in contact with the levelling cord or, alternatively, passes through the core cord and through the levelling cord. In either case, the stitching thread is retained in position by both the core cord and the levelling cord, so that the coupling element can be securely maintained in the correct attitude on the support tape for positive engagement with the corresponding coupling element of the complementary fastener stringer.

The above and other objects, features and advantages of this invention and the manner of attaining them will become more readily apparent, and the invention itself will best be understood, from the following description and appended claims taken in connection with the accompanying drawings.

DESCRIPTION OF THE PREFERRED EMBODIMENTS

Figure 1:
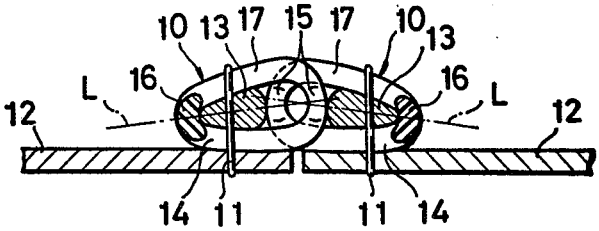
FIG. 1 is a cross-sectional view of a conventional pair of slide fastener stringers including coil-type continuous coupling element of the oval-shaped cross-section.

The aforementioned problem attendant upon the prior art will become more clearly apparent by referring to FIGS. 1 through 4 of the drawings. With particular reference to FIG. 1, the illustrated conventional pair of slide fastener stringers have a pair of continuous coupling elements 10 each in the form of a coil of a filamentary synthetic resin with the turns thereof being substantially oval in shape and adapted to provide a series of scoops for interfitting engagement with the scoops of the other coupling element. The continuous coupling elements 10 are stitched at 11 to the confronting front edges of support tapes 12 respectively. A core cord 13 extends through the interior of each coiled coupling element 10 in the longitudinal direction thereof, and each stitching thread 11 passes through this core as it fastens the coupling element to the respective support tape 12.

In the conventional pair of fastener stringers of the above outlined construction, the lower shank 14 of each scoop of each continuous coupling element 10 lies flat against the respective support tape 12. As a consequence, the notional line L connecting the midpoints of each coupling head 15 and the corresponding bight portion 16 of each continuous coupling element is oriented at an angle to the plane of the corresponding support tape 12, such that the upper shank 17 of each scoop slopes downwardly as it extends from the coupling head toward the bight portion.

Figure 2:
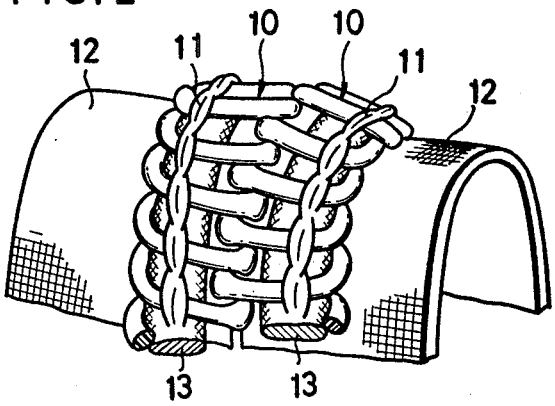
FIG. 2 is a perspective view showing the conventional pair of fastener stringers of FIG. 1 as bent about an axis extending in their transverse direction.
Figure 4:
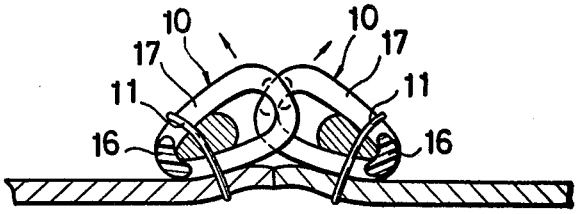
FIG. 4 is a view similar to FIG. 1 but explanatory of the way the stitches tend to slip off the coupling elements of the conventional fastener stringers when they are bent as shown in FIG. 2.
Figure 3:
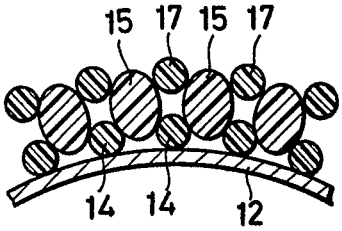
FIG. 3 is a partial longitudinal sectional view of the conventional pair of fastener stringers of FIG. 1, the view being explanatory of the forces exerted on the coupling elements when the stringers are bent as shown in FIG. 2.

Thus, when the conventional pair of fastener stringers with their coupling elements 10 interengaged are bent about an axis transverse to the fastener as shown in FIG. 2, the spacings between the lower shanks 14 become reduced at the curved region of each coupling element, whereas the spacings between the upper shanks 17 become widened at that region of each coupling element, as will be apparent from FIG. 3. The coupling heads 15 of each coupling element 10 are therefore thrusted upwardly and tend to move out from between the upper shanks 17 of the other coupling element. Furthermore, as best shown in FIG. 4, those portions of the stitching threads 11 which pass over the sloping upper shanks 17 of the coupling elements 10 slip toward their bight portions 16 as the threads are tensioned as a result of the bending of the fastener stringers.

It is thus seen that the coupling elements 10 become insecurely attached to the respective support tapes 12 at their curved regions and therefore susceptible to partial dislocation or disengagement upon exertion of a crosswise pull on the fastener stringers. This disadvantage of the prior art is thoroughly overcome by this invention, which is described hereinbelow in terms of some preferred embodiments thereof illustrated in FIGS. 5 through 7.

Figure 5:
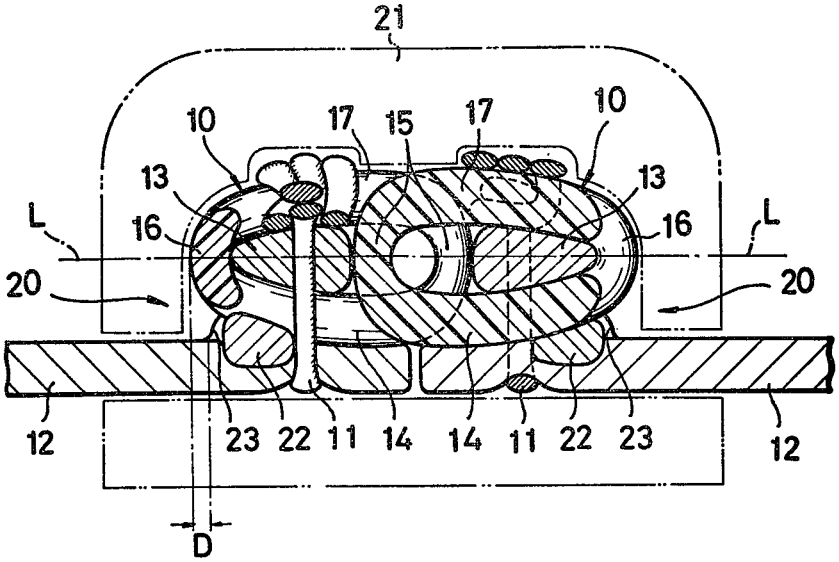
FIG. 5 is a cross-sectional view of a pair of slide fastener stringers cnstructed in accordance with the principles of this invention.

FIG. 5 shows a pair of slide fastener stringers 20 embodying this invention, together with a phantom slider 21 for use with the fastener stringers. Since both fastener stringers are identical in construction, only one of them will be described in detail, and various corresponding parts of the two fastener stringers will be designated by the same reference numerals.

The slide fastener stringer 20 in accordance with this invention includes the continuous coupling element 10 of the prior art type shown in FIGS. 1 through 4. As mentioned, the continuous coupling element 10 is a coil of filamentary synthetic-resin material, with the turns thereof being substantially oval-shaped and adapted to provide a series of scoops including the coupling heads 15 for mating interengagement with the similar coupling heads of the complementary coupling element 10 of the other fastener stringer. Each turn or scoop of the coiled coupling element 10 further includes the paired lower and upper shanks 14 and 17 extending rearwardly from the coupling head 15 and respectively connected by the bight portions 16 to the succeeding and the preceding turns or scoops. The spacing between the lower and the upper shanks 14 and 17 is made less at their rear end portions than at their front end portions.

Figure 6:
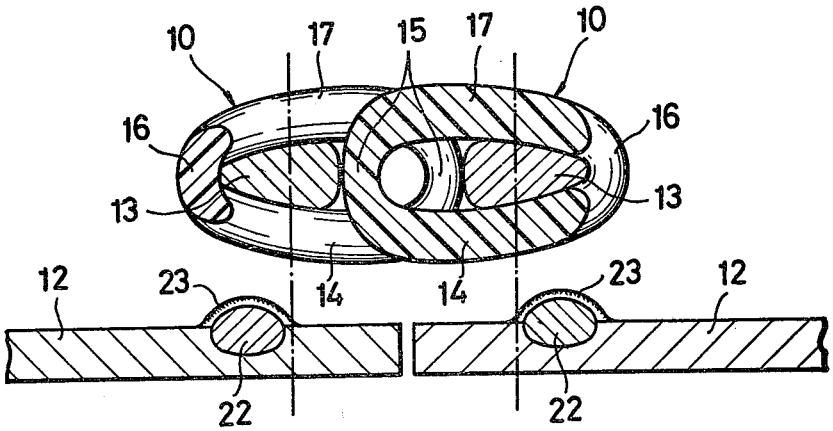
FIG. 6 is a cross-sectional view showing the continuous coupling elements and support tapes of the fastener stringers of FIG. 5 before the coupling elements are stitched onto the support tapes.

With reference directed also to FIG. 6, the support tape 12 for supporting the continuous coupling element 10 of the foregoing configuration is of a woven fabric substantially integrally comprising a levelling cord 22 which extends longitudinally of the support tape and which is located in the adjacency of its front edge. The levelling cord 22 is at least partly raised from one of the surfaces, directed upwardly in the drawings, of the support tape 12.

Preferably, the levelling cord 22 is fabricated of a multiplicity of threads or yarns laid parallel to each other or twisted together. In the illustrated embodiment, the levelling cord 22 is woven into the support tape 12 and held in position by the weft 23 of the support tape. Alternatively, the levelling cord 22 may be bonded, fused, stitched, or otherwise substantially integrally attached to the completed support tape.

The continuous coupling element 10 lies on the upper surface of the support tape 12 and extends longitudinally along its front edge, with the coupling heads 15 of the scoops projecting beyond the front edge of the tape. The coupling element 10 is fastened to the support tape 12 by the row of stitches 11 passing through the core cord 13 which extends through the interior of teh coupling element along the full length thereof and which is disposed in close contact with the bight portions 16 of the couplng element.

It will be noted from FIG. 5 that the lower shanks 14 of the coupling element 10 rest on the levelling cord 22 at their regions adjacent the bight portions 16, and that the stitching thread 11 passes through the support tape 12 on the front side of the levelling cord and in contact with the latter. Thus, the coupling element 10 securely rests upon the front edge portion of the support tape 12 and upon the levelling cord 22 and is effectively urged thereagainst by the stitching thread 11, in such a manner that the notional line L extending between the midpoint of the coupling head 15 and the midpoint of the bight portion 16 is oriented parallel to the plane of the support tape.

The rear edge of the levelling cord 22 is set forwardly of the rear ends of the turns of the coupling element 10 by a suitable distance D. This is to permit smooth sliding movement of the slider 21 along the pair of coupling elements 10 in the act of opening or closing the fastener.

In accordance with this invention, as will be evident from the foregoing, the continuous coupling elements 10 are held levelled on the respective support tapes 12 by the levelling cords 22, and further the row of stitches 11 of each fastener stringer 20 is securely retained in position by both the core cord 13 and the levelling cord 22. Thus, even when the closed slide fastener comprising the pair of stringers 20 is bent about a transverse axis, as shown in FIG. 2 in connection with the prior art, the stitching threads 11 will not slip toward the bight portions of the coupling elements 10 and will positively hold these coupling elements interengaged.

Figure 7:
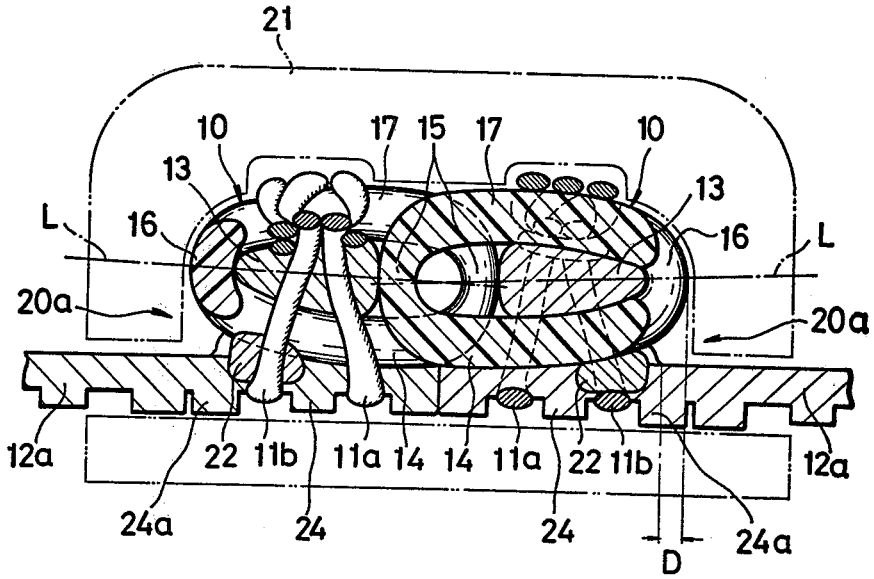
FIG. 7 is a view similar to FIG. 5 but showing another preferred embodiment of the invention.

A pair of slide fastener stringers **20*a* shown in FIG. 7 by way of another preferred embodiment of this invention differs from the preceding embodiment principally in that their support tapes 12*a* are each of a warp-knitted fabric having a plurality of spaced-apart wales 24 formed on its lower surface and extending in its longitudinal direction. As in the preceding embodiment, each warp-knitted fabric tape 12*a* is substantially integrally provided with the levelling cord 22 on its flat upper surface. This levelling cord is disposed in a position corresponding to the groove between two adjacent ones of teh wales 24 on the lower surface of the support tape 12*a***.

The method of stitching each coupling element 10 to the respective support tape **12*a* also slightly differs from that in the preceding embodiment. The stitching thread includes portions 11*a* passing through the core cord 13 and the support tape 12*a*, and portions 11*b* passing through the core cord, the levelling cord 22** and the support tape.

As in the preceding embodiment, the rear edge of each levelling cord 22 is set forwardly of the rear ends of the turns of the coupling element 10 by the distance D. In the illustrated embodiment, the third wale 24a of each support tape 12a, as counted rearwardly from the front edge of the tape, is made greater in width than the other wales as by use of a thicker chain stitching thread. It is possible in this manner to set the rear edge of each levelling cord 22 sufficiently forwardly of the rear ends of the turns of the coupling element 10 and hence to provide the desired distance D therebetween.

In this second embodiment, each coupling element 10 is so mounted on the respective support tape 12a that the notional line L connecting the midpoints of each coupling head 5 and the corresponding bight portion 16 is made slightly higher on its bight portion side than on its coupling head side, although this notional line can be oriented parallel to the plane of the support tape 12a without any substantial modification of the construction of the fastener stringer 20a.

The other details of construction of the pair of fastener stringers 20a are identical with those set forth in connection with the pair of fastener stringers 20 of FIGS. 5 and 6. It will also be evident that the coupling elements 10 of the fastener stringers 20a are securely attached to the respective support tapes 12a, without the possibility of dislodgement or undersired disengagement.

Although the slide fastener stringers in accordance with this invention have been shown and described in terms of their preferable forms, it is understood that such detailed disclosure is by way of example only and is not to impose limitations upon the invention. Various modifications and variations of this invention will readily occur to those skilled in the art without departing from the spirit or scope of the appended claims.

What is claimed is:

1. A slide fastener stringer for combined use with another stringer of identical construction, comprising a support tape, a leveling cord formed substantially integral with the support tape and extending longitudinally thereof, the leveling cord being located in the adjacency of a longitudinal edge of the support tape and being at least partly raised from one of the surfaces thereof, a continuous coupling element lying on one said surface of the support tape and extending along said longitudinal edge thereof, the continuous coupling element being in the form of a coil of synthetic-resin material with the turns thereof being substantially oval-shaped and having a row of coupling heads for mating interengagement with corresponding coupling heads of the other stringer and bight portions serving to connect the turns of the coil and pairs of upper and lower shanks extending between the coupling heads and the bight portions, the lower shanks of the coupling element resting on the leveling cord at their regions in the adjacency of the bight portions whereby a notional line extending between the mid point of each coupling head and the mid point of the corresponding bight portion is oriented substantially parallel to the plane of the support tape, and securing means including a row of stitches extending along the coupling element for securing same to the support tape, said securing means further including a core extending through the interior of the coil and disposed in contact with the bight portions thereof, the row of stitches passing through the core, and the row of stitches passing through the support tape on the same side of the leveling cord as said longitudinal edge of the support tape and being held in contact with the leveling cord.

2. A slide fastener stringer for combined use with another stringer of identical construction, comprising a support tape, a leveling cord formed substantially integral with the support tape and extending longitudinally thereof, the leveling cord being located in the adjacency of a longitudinal edge of the support tape and being at least partly raised from one of the surfaces thereof, a continuous coupling element lying on one said surface of the support tape and extending along said longitudinal edge thereof, the continuous coupling element being in the form of a coil of synthetic-resin material with the turns thereof being substantially oval-shaped and having a row of coupling heads for mating interengagement with corresponding coupling heads of the other stringer and bight portions serving to connect turns of the coil and pairs of upper and lower shanks extending between the coupling heads and the bight portions, the lower shanks of the coupling element resting along the leveling cord at their regions in the adjacency of the bight portions whereby a notional line extending between the mid point of each coupling head and the mid point of the corresponding bight portion is oriented substantially parallel to the plane of the support tape, and securing means including a row of stitches extending along the coupling element for securing same to the support tape, the securing means further including a core extending through the interior of the coil and disposed in contact with the bight portion thereof, the row of stitches passing through the core, the support tape being of a warp-knitted fabric having a plurality of spaced-apart wales formed on the other surface of the support tape and extending longitudinally thereof, the leveling cord being disposed in a position on said one surface of the supprt tape corresponding to the spacing between two adjacent ones of the wales on said other surface of the support tape, the row of stitches passing through the leveling cord.

3. A slide fastener stringer comprising a support tape; a levelling cord formed substantially integral with the support tape and extending longitudinally thereof; a continuous coupling element in the form of a coil with the turns thereof being substantially oval-shaped and having coupling heads, bight portions and upper and lower shanks extending therefrom; and a securing means including a core extending through the interior of the coil and being disposed in contact with the bight portion, said securing means further including a row of stitches extending around the upper and lower shanks and passing through the core to fasten the lower shanks on one surface of the support tape and to position the lower shanks to rest on the levelling cord at their regions in the adjacency of the bight portions while the rear edge of the levelling cord is set forwardly on the rear ends of the turns of the coupling element by a predetermined distance so as to permit smooth sliding movement of a slider therealong.

4. A slide fastener stringer according to claim 3 wherein the row of stitches passes through the support tape on the front side of the levelling cord and in contact therewith.

* * * * *